US009840890B2

(12) United States Patent
Nordheimer

(10) Patent No.: US 9,840,890 B2
(45) Date of Patent: Dec. 12, 2017

(54) SYSTEM FOR SUCCESSIVELY UNCOVERING PORTS ALONG A WELLBORE TO PERMIT INJECTION OF A FLUID ALONG SAID WELLBORE

(71) Applicant: STAGE COMPLETIONS INC., Calgary (CA)

(72) Inventor: David Nordheimer, Calgary (CA)

(73) Assignee: SC ASSET CORPORATION (CA)

( * ) Notice: Subject to any disclaimer, the term of this patent is extended or adjusted under 35 U.S.C. 154(b) by 328 days.

(21) Appl. No.: 14/697,271

(22) Filed: Apr. 27, 2015

(65) Prior Publication Data

US 2016/0312580 A1 Oct. 27, 2016

Related U.S. Application Data

(63) Continuation-in-part of application No. 14/505,384, filed on Oct. 2, 2014, now Pat. No. 9,587,464.

(51) Int. Cl.
*E21B 34/14* (2006.01)
*E21B 33/14* (2006.01)
(Continued)

(52) U.S. Cl.
CPC ..... *E21B 34/14* (2013.01); *E21B 33/146* (2013.01); *E21B 34/063* (2013.01); *E21B 43/26* (2013.01); *E21B 2034/007* (2013.01)

(58) Field of Classification Search
CPC ... E21B 34/14; E21B 2034/007; E21B 34/103
See application file for complete search history.

(56) References Cited

U.S. PATENT DOCUMENTS 3,263,752 A 8/1966 Conrad
7,325,617 B2 2/2008 Murray
(Continued)

FOREIGN PATENT DOCUMENTS

CA 2867207 A1 12/2014
WO 2007112211 A1 10/2007
(Continued)

OTHER PUBLICATIONS

International Searching Authority—Canadian Intellectual Property Office, International Search Report and Written Opinion, dated Jul. 21, 2015—International Application No. PCT/CA2015/050348, filed Apr. 27, 2015.
(Continued)

*Primary Examiner* — Jennifer H Gay
*Assistant Examiner* — Steven A Macdonald
(74) *Attorney, Agent, or Firm* — Gowling WLG (Canada) LLP; D. Doak Horne

(57) ABSTRACT

A system for successively uncovering a plurality of contiguous ports in a tubing liner within a wellbore, or for successively uncovering individual groups of ports arranged at different but adjacent locations along the liner, to allow successive fracking of the wellbore at such locations. Sliding sleeves in the tubing liner are provided, having a circumferential groove therein, which are successively moved from a closed position covering a respective port to an open position uncovering such port by an actuation member placed in the bore of the tubing liner. Each actuation member comprises a dissolvable plug which in one embodiment is retained by shear pins at an uphole end of a collet sleeve, the latter having radially-outwardly biased protuberances (fingers) which matingly engage sliding sleeves having cylindrical grooves therein, based on the width of the protuberance. In one embodiment, when actuating the most
(Continued)

downhole sleeve, the shear pin shears allowing the plug to move in the collet sleeve and prevent the protuberance (fingers) from disengaging.

13 Claims, 5 Drawing Sheets

(51) Int. Cl.

| | |
|---|---|
| ***E21B 34/06*** | (2006.01) |
| ***E21B 43/26*** | (2006.01) |
| *E21B 34/00* | (2006.01) |

(56) References Cited

U.S. PATENT DOCUMENTS

| | | | |
|---|---|---|---|
| 7,552,779 | B2 | 6/2009 | Murray |
| 9,611,727 | B2 | 4/2017 | Campbell et al. |
| 9,739,117 | B2 | 8/2017 | Campbell et al. |
| 2013/0068484 | A1 | 3/2013 | Themig et al. |
| 2014/0246207 | A1 | 9/2014 | Hofman et al. |
| 2016/0251923 | A1 | 9/2016 | Keerthivasan et al. |

FOREIGN PATENT DOCUMENTS

| | | | |
|---|---|---|---|
| WO | 2011146210 | A1 | 11/2011 |
| WO | 2012045165 | A1 | 4/2012 |
| WO | 2013070446 | A1 | 5/2013 |

OTHER PUBLICATIONS

Site Oil Tools LTD.—1981-82 Wireline Production Equipment Catalogue.

200
W
220
205
213
212
210
W
220
204

200
220
205
213
212
210
240
234
234
232
204
202

200
220
205
232
250
202
210
220
220
204

200
220
232
240
234
202
240
205
206''
210
220
220
206'
204

200
220
206''
205
213
W2
220
206'
204
212
210
250
202
220
W1
206
203
211

200
W2
206''
250
206'
202
210
220
W1
206
211

200
206''
W2
202
250
W2
206'
210
220
W1
206

250
200
206''
W2
206'
210
W1
206

SYSTEM FOR SUCCESSIVELY UNCOVERING PORTS ALONG A WELLBORE TO PERMIT INJECTION OF A FLUID ALONG SAID WELLBORE

CROSS-REFERENCE

This application claims the benefit of priority from commonly-assigned U.S. patent application Ser. No. 14/505,385 filed Oct. 2, 2014 corresponding to Canadian Patent Application CA 2,867,207 filed Oct. 3, 2014 and published Dec. 16, 2014, both of which are entitled 'MULTI-STAGE LINER WITH CLUSER VALVES AND METHOD OF USE" and incorporated herein by reference.

FIELD OF THE INVENTION

The present invention relates to multi-stage liners used in open hole or cased completions for injection of fluids at successive contiguous locations along a wellbore to create multiple fractures in a hydrocarbon zone along the wellbore.

BACKGROUND OF THE INVENTION

This background and documents mentioned below are provided for the purpose of making known information believed by the applicant to be of possible relevance to the present invention, and in particular allowing the reader to understand advantages of the invention over devices and methods known to the inventor, but not necessarily public. No admission is necessarily intended, nor should be construed as admitting, that any of the following documents or methods known to the inventor constitute legally citable prior art against the present invention.

After an oil or gas well is drilled within an underground hydrocarbon formation, the zones of interest need to be completed, namely conditioned typically by a fracking operation, in order to most quickly and to the greatest extent possible produce oil and/or gas from each particular zone. If the zone of interest requires a type of fracture stimulation, including but not limited to acid fracture or propped fracture, the zone of interest will be isolated to focus the fracture on the particular zone, and to prevent fracture in other zones which may not be desired.

Liner systems can be used prior to conducting the fracture stimulation and can be run in either open hole or cased hole applications.

In the stimulation of directional and horizontal wells, it can be desirable to treat multiple stages in a single zone, known as a cluster, with a single fracture stimulation. It can also be desirable to treat more than one zone with a single fracture stimulation to save time and expense associated with multiple treatments and time spent running tubing and tools in and out of the wellbore.

Various downhole tools and systems have been used to stimulate wells by permitting treatment/fracturing in multiple contiguous regions within a single zone. Many of such tools and systems require components within the bore of the liner at each valve which disadvantageously restricts flow of fluid through the liner during fracture pumping operations, and also, to the extent such systems or remnants thereof remain, similarly restrict production of hydrocarbons. Due to such flow restrictions, pressure drops occur, which result in less efficient operations as there is pressure loss incurred prior to the fracture fluid contacting the zone. Ideally, less pressure drop is desired to conduct a fracture stimulation more efficiently in each stage and in addition. In addition, such tools and methods require milling out of such components at each valve location prior to switching to production flow from the hydrocarbon bearing zones. It is desirous to have fewer materials/components to mill out within the bore liner immediately prior to commencing production from the hydrocarbon bearing zones.

Numerous patents and pending patent applications exist related to apparatus and systems for opening a plurality of ports in a liner within a wellbore at multiple contiguous locations therealong, to thereby permit injection of a fluid from such liner into a hydrocarbon formation, typically for the purpose of fracturing the formation at such locations.

For example, U.S. Pat. No. 8,215,411 teaches a plurality of opening sleeve/cluster valves along a liner for wellbore treatment, and utilizes a ball member or plug to open a sleeve at each valve thereby allowing fluid communication between the bore and a port in the sleeve's housing. This invention requires, however, a ball seat corresponding to each sleeve in a cluster valve, potentially restricting flow. The presence of a ball seat at each valve to be opened, due to the resulting bore restriction at each valve sleeve, creates a significant pressure drop across the cluster valve assembly.

U.S. Pat. No. 8,395,879 teaches a hydrostatically powered sliding sleeve. Again, such configuration utilizes a single ball, but each sliding sleeve configuration requires its own ball seat.

U.S. Pat. No. 4,893,678 discloses a multiple-set downhole tool and method that utilizes a single ball. Again, each valve requires a seat which is integral with a sliding sleeve, and which remains with each valve/port. When the sleeve/seat is forced by the ball to slide and thereby open the port, collet fingers may then move radially outwardly, disengaging the ball and allowing the ball to further travel downhole to actuate (open) further ports.

US Patent Application Publication No. 2014/0102709 discloses a tool and method for fracturing a wellbore that uses a single ball, each valve with a deformable ball seat. Again, each valve has a valve seat which remains with each valve/port.

Other patents and published applications avoid the problem of each valve/port having a ball seat which remains with each valve, and provide a dart or ball member which actuates a number of valves/ports. However, such designs are not without their own unique drawbacks.

For example, US 2013/0068484 published Mar. 21, 2013, inter alia in FIG. 6 thereof, (and likewise to same effect US 2004/0118564 published Jun. 24, 2004, likewise in FIG. 6 thereof) teaches an axially movable sliding sleeve 322 which is capable of actuating (i.e. opening) a number of downhole port sleeves 325*a*, 325*b* to thereby open corresponding respective downhole ports 317*a*, 317*a*' which are normally covered by port sleeve 325*a*, and similarly subsequently open respective downhole ports 317*b*, 317*b*' normally covered by port sleeve 325*b*. Sliding sleeve 322 is mounted by a shear pin 350 in the tubing string. Plug/ball 324 is inserted in the tubing, and uphole fluid pressure applied thereto cause plug 324 to travel downwardly in the in the string and abut sliding sleeve 322, further causing shear pin 350 to shear and thus sleeve 322 to then be driven downhole. Spring-biased dogs 351 on outer periphery of sliding sleeve 322 then engage inner profile 353*a* on sliding sleeve 325*a* and cause sleeve 325*a* (due to fluid pressure acting on plug 324) to move downhole thereby opening ports 317*a*, 317*a*'. As noted in paragraph [0071] therein, continued application of fluid pressure causes dogs 351 to collapse, thereby releasing sleeve 322 from engagement with inner profile 353*a* on sliding sleeve 325, and allowing sleeve 322 to further travel downhole and actuate (i.e. open) further sleeves in like manner. Although not expressly mentioned nor shown in US 2013/0068484, seals are necessary around dogs 351 in order to allow creation of a pressure differential when such continued application of fluid pressure is applied, in order to cause collapse of such dogs to allow disengagement with a first sleeve and allow the dart to thereafter further travel downhole for subsequent actuation of additional downhole sleeves and ports. The necessity for seals around dogs 351 necessarily introduces added mechanical complexity and the possibility of inability to release sleeve 322 from engagement if such seals were to leak due to the then-inability to create a pressure differential.

WO 2013/048810 entitled "Multizone Treatment System" published Apr. 4, 2013 teaches a system and method for successively opening flow control devises (which may be sliding sleeves) in a tubing string along a length thereof, commencing with a most downhole valve and opening a sleeve at such location, and by insertion of additional darts progressing successively upwardly in the tubing string to open further uphole sleeves. The tubing string is provided with a plurality of spaced apart flow control devices, such as sliding sleeves, each having an annulary-located recess therein with a unique profile relative to other flow control devices. A first dart, having an engagement feature sized to correspond with a selected annulary-located recess of a particular most-downhole flow control device, is injected, and such dart passes to actuate the flow control device to allow it to open a port. The process is progressively repeated for additional uphole flow control devices by injecting additional darts, having corresponding features to engage a selected flow control device. The darts are then drilled out to allow production from the tubing. Disadvantageously, only one dart can open one port, and thus a plurality of contiguously spaced ports are not capable of being opened by a single dart using such apparatus/method, thereby rendering such system/method time consuming.

CA 2,842,568 entitled "Apparatus and Method for Perforating a Wellbore Casing, and Method and Apparatus for Fracturing a Formation" published May 29, 2014 teaches inter alia dart members similar to the dart of WO 2013/048810, each dart having a protruding spring-biased profile uniquely sized to engage a similarly-sized annular recess on a plurality of downhole sliding sleeves, and thereby open sliding sleeve, with further means being provided on each of such sliding sleeves to allow the single dart member to further travel downhole and open additional sleeves having similar-sized annular recesses. No collet sleeve is provided, and a non-beveled (non-chamfered) surface on the annular recess of the most downhole sleeve is used to retain the dart from travelling further downhole.

SUMMARY OF THE INVENTION

It is an object of the invention to provide an additional alternative system to existing systems and methods for opening contiguously spaced-apart ports located along a tubing within a wellbore to allow injection of fluid into a hydrocarbon formation.

It is a further object of the present invention, in certain embodiments thereof, to provide a system which may selectively open groups of continuous ports along a tubing liner separately, to allow separate and discrete fracking of various differently-located hydrocarbon zones which may exist along a length of a tubing liner within a wellbore in a hydrocarbon formation.

It is a still further object of the present invention to provide a system which can do each of the above, yet nevertheless provide a minimum restriction to the bore of the tubing liner to thereby maximize production and flow rate of hydrocarbon therefrom.

It is a still further object of certain embodiments of the present invention to be able to accomplish each of the foregoing objects, yet nonetheless not have to, after the completion of the opening of the ports and the fracking process, insert a reamer to ream out any remaining flow obstructions within the tubing liner, and thereby avoid additional steps prior to being able to produce hydrocarbons from a wellbore.

Accordingly, in a first broad embodiment, the present invention provides for a system for successively uncovering a plurality of contiguous spaced-apart ports along a wellbore, comprising:

(i) A Tubular Liner Having a Bore, Further Comprising:

(a) a plurality of said spaced-apart ports longitudinally and contiguously spaced along said tubular liner;

(b) a corresponding plurality of cylindrical sliding sleeve members, each longitudinally slidable within said bore, each configured in an initial closed position to overlap a corresponding of said ports, and when slidably moved to an open position to uncover said corresponding port, each of said sliding sleeve members having an interior circumferential groove therein;

(c) a shear member, initially securing said slidable sleeve members in said initial closed position, and sheareable when a force is applied to a respective of said slidable sleeve members;

(ii) an actuation member positioned within said bore, comprising:

(a) a cylindrical hollow collet sleeve, having a radially-outwardly biased and protruding protuberance, said protuberance configured to successively matingly engage each of said respective interior circumferential grooves on said sliding sleeve members, wherein said protuberance is of a substantially equal or lesser width than a width of said circumferential grooves on each of said sliding sleeve members, wherein said protuberance may be inwardly compressed to allow said collet sleeve and protuberance thereon to become disengaged from mating engagement in said circumferential groove;

(b) a plug member, situated within said collet sleeve and when in a first position situated at an uphole end thereof, which at least for a limited time together with said collet sleeve substantially obstructs passage of fluid within said bore when said collet sleeve and plug member are together situated in said bore;

(c) a shear pin, releasably securing said plug member to an uphole end of said collet sleeve, shearable when a force is applied to said plug member to cause said plug member to move downhole in said collet sleeve to a second position therein preventing said protuberance from thereafter being forcibly inwardly compressed and thereby maintaining said protuberance in mating engagement with said circumferential groove;

wherein fluid pressure applied to an uphole end of said actuation member causes said actuation member to move downhole and successively engage said circumferential groove in each of said sliding sleeve members and move said sliding sleeve members downhole so as to thereby uncover each of said plurality of ports;

wherein fluid pressure required to shear said shear members in all of said slidable sleeve members save and except for a most-downhole of said slidable sleeve members, is less than fluid pressure required to shear said shear pins securing said plug member to said uphole end of said collet sleeve; and wherein said plug member, when opening a most-downhole sliding sleeve member, shears said shear pin therein and moves downhole in said collet sleeve from said first position therein to said second position thereby preventing said protuberance from being inwardly compressed.

In a further refinement, the tubing liner is further provided with burst plates covering each of said ports, said burst plates adapted to rupture and allow fluid communication from said bore to said port upon a fluid pressure in said bore being higher than and exceeding the fluid pressure necessary to:

(i) cause said plug member and collet sleeve to shear said shear member; and (ii) cause said plug member to shear said shear pin and move to said plug member to said second position.

In a still further refinement, the plug member is dissolvable, and after moving to said second position and after a period of time being exposed to fluid within said bore, becomes dissolved. Such advantageously avoids having to insert a downhole reamer within the tubing liner, once fluid injection into the formation via the opened ports has been completed, in order to ready the tubing liner for production so as to allow hydrocarbons from locations further downhole to flow uphole to surface.

In a further refinement of the aforementioned system, means is provided to lock the sliding sleeves in the open position once such sliding sleeves have been moved by the plug and collet sleeve to the open position uncovering such ports. Thus in a preferred embodiment, a snap ring member is provided with each of said plurality of sliding sleeve members, which snap ring member locks each sliding sleeve member in said open position when said sliding sleeve member is moved to said open position. Other similar means of locking each sliding sleeve in an open position will now occur to persons of skill in the art, and are likewise alternatively contemplated for use in the system of the present invention to lock the sliding sleeves in the open position.

In a still further refinement, the plug member upon movement to said second position prevents said protuberance from being inwardly compressed, and said actuation member is further prevented along from further movement downhole.

In a further preferred embodiment, a plurality of actuation members, each comprised of a collet sleeve having a protuberance thereon of a different with, are utilized to uncover a plurality of groups of discrete/separate spaced apart ports, wherein each of the groups of ports in the liner are positioned in different zones of the formation. Such allows injection of fluid in separate zones of the wellbore, at a time and in a sequence determined by the completions engineer who controlling the fracking/completion process to be most optimal for allowing greatest recovery from the well.

Accordingly, in such further preferred embodiment of the system of the present invention, a system for successively uncovering at least two separate groups of contiguous spaced-apart ports along a wellbore is provided, comprising:

(i) a tubular liner having a bore, further comprising:

(a) a plurality of first spaced-apart ports longitudinally spaced along said tubular liner;

(b) a corresponding plurality of first cylindrical sliding sleeve members, each longitudinally slidable within said bore, each configured in an initial closed position to overlap a corresponding of said first ports and when slidably moved to an open position to not overlap said first port, each of said sliding sleeve members having an interior circumferential groove therein of a first width;

(c) a plurality of said second spaced-apart ports longitudinally and contiguously spaced along said tubular liner, situated in said tubular liner downhole from said first ports;

(d) a corresponding plurality of second cylindrical sliding sleeve members, each longitudinally slidable within said bore, each configured in an initial closed position to overlap a corresponding of said second ports and when slidably moved to an open position to not overlap said corresponding second port, each of said second sliding sleeve members having an interior circumferential groove therein of a second width, wherein said second width is greater than said first width;

(e) shear members, respectively securing said first and second slidable sleeve members in said initial closed position, and shearable when a force is applied to a respective of said first and second slidable sleeve members;

(ii) a first actuation member positioned within said bore, comprising:

(a) a cylindrical hollow collet sleeve, having a plurality of elongate longitudinally extending finger members thereon, said finger members having thereon a radially-outwardly protruding protuberance, said protuberance configured to successively matingly engage said respective interior circumferential groove on each of said second sliding sleeve members, wherein said protuberance is of a width substantially equal to said second width but greater than said first width, wherein said protuberance may upon fluid pressure being applied to an uphole side of said first actuation member be inwardly compressed to allow said collet sleeve and protuberance thereon to become disengaged from mating engagement in said circumferential groove in each of said second sliding sleeve members;

(b) a plug member, situated within said collet sleeve and when in a first position situated at an uphole end of said collet sleeve, which at least for a limited time together with said collet sleeve substantially obstructs passage of fluid within said bore when said collet sleeve and plug member are together situated in said bore;

(c) a shear pin, releasably securing said plug member to an uphole end of said collet sleeve, shearable when a force is applied to said plug member to cause said plug member to move downhole in said collet sleeve to a second position therein preventing said finger members from thereafter being forcibly inwardly compressed and thereby maintaining said protuberance in mating engagement with said circumferential groove;

wherein fluid pressure applied to an uphole end of said first actuation member causes said first actuation member to move downhole and cause said collet sleeve thereof to successively engage said second circumferential groove in each of said second slidable sleeve members and move each of said second sliding sleeve members downhole so as to thereby uncover each of said plurality of second ports;

wherein fluid pressure required to shear said shear members in all of said second slidable sleeve members save and except for a most-downhole of said slidable sleeve members, is less than fluid pressure required to shear said shear pins securing said plug member to said uphole end of said collet sleeve; and wherein said plug member in said first actuation member, when opening a most-downhole second sliding sleeve member, shears said shear pin therein and moves downhole in said collet sleeve from said first position therein to said second position thereby preventing said protuberance from being inwardly compressed;

said system further comprising:

(iii) a second actuation member positioned within said bore, comprising:

(a) a cylindrical hollow collet sleeve, having a plurality of elongate longitudinally extending finger members thereon, said finger members having thereon a radially-outwardly protruding protuberance, said protuberance configured to successively matingly engage said respective interior circumferential groove on each of said first sliding sleeve members, wherein said protuberance is of a width substantially equal to said first width, but less than said second width, wherein said protuberance may be inwardly compressed to allow said collet sleeve and protuberance thereon to become disengaged from mating engagement in said first circumferential groove in each of said first sliding sleeve members;

(b) a plug member, situated within said collet sleeve and when in a first position situated at an uphole end of said collet sleeve, which at least for a limited time together with said collet sleeve substantially obstructs passage of fluid within said bore when said collet sleeve and plug member are together situated in said bore;

(c) a shear pin, releasably securing said plug member to an uphole end of said collet sleeve, shearable when a force is applied to said plug member to cause said plug member to move downhole in said collet sleeve to a second position therein preventing said finger members from thereafter being forcibly inwardly compressed and thereby maintaining said protuberance in mating engagement with said circumferential groove;

wherein fluid pressure applied to an uphole end of said second actuation member causes said second actuation member to move downhole and said collet sleeve thereof successively engage said circumferential grooves in each of said first slidable sleeve members and move each of said first sliding sleeve members downhole so as to thereby uncover each of said plurality of first ports; and wherein fluid pressure required to shear said shear members in all of said first slidable sleeve members save and except for a most-downhole of said first slidable sleeve members, is less than fluid pressure required to shear said shear pins securing said plug member to said uphole end of said collet sleeve of said second actuation member.

In a further embodiment the plug member of said second actuation member, when opening a most-downhole sliding sleeve member, shears said shear pin therein and moves downhole in said collet sleeve from said first position therein to said second position thereby preventing said protuberance from being inwardly compressed.

In a further refinement burst plates may likewise be provided covering each of said first and second ports, said burst plates adapted to rupture and allow fluid communication from said bore to said port only upon a fluid pressure in said bore exceeding:

(i) the fluid pressure necessary to cause said plug member in each of said first and second actuation member and said associated collet sleeve to shear said shear member; and (ii) the fluid pressure necessary to cause said plug member in each of said first and second actuation member to shear said shear pin and move to said plug member to said second position in each collet sleeve.

In such manner, as fracking operations are typically conduced commencing with a most downhole/furthest extremity of the wellbore, the wellbore may be progressively fracked in each zone, commencing from the most downhole/furthest extremity of the wellbore.

The above summary of the invention does not necessarily describe all features of the invention. For a complete description of the invention, reference is to further be had to the drawings and the detailed description of some preferred embodiments, read together with the claims.

BRIEF DESCRIPTION OF THE DRAWINGS

Further advantages and other embodiments of the invention will now appear from the above along with the following detailed description of the various particular embodiments of the invention, taken together with the accompanying drawings each of which are intended to be non-limiting, in which:

FIGS. 1A-1D show a series of sequential views of a tubing liner incorporating the system of the present invention, with:

FIG. 1A is an initial view showing the tubing liner with the ports and corresponding sleeves in the closed position;

FIG. 1B is a subsequent view showing the tubing liner with the actuation member inserted in the liner and the collet sleeve and protuberances thereon engaging the first sliding sleeve member;

FIG. 1C is a subsequent view showing the actuation member having moved the most uphole sliding sleeve member so as shear the shear members and force the associated sliding sleeve member to move dowhole so as to thereby uncover its associated port, such actuation member having disengaged from such sliding sleeve member and in the process of moving further downhole to similarly open a further downhole sliding sleeve member and associated port; and FIG. 1D is a subsequent view showing the actuation member having engaged the more downhole sliding sleeve member and having sheared the associated shear members thereof and having moved such sleeve member downhole so as to likewise uncover its associated port, with the plug member having further sheared its retaining shear pins and moved downhole within the collet sleeve thereby preventing the protuberances on the collet sleeve from disengaging from the associated sliding sleeve member and the plug member and associated collet sleeve being further prevented from moving further downhole;

FIGS. 2A-2D show a series of sequential views of a tubing liner incorporating a further refinement of the system of the present invention, namely comprising two different types of sliding sleeve members intended to be separately actuated by different actuation members, with:

FIG. 2A showing a tubing liner with the ports and corresponding sleeves in the closed position, and in particular with two types of sliding sleeve members, a first group thereof (the most uphole slidable sleeve member shown) having a circumferential groove of lesser width than the circumferential groove in adjacent downhole sliding sleeve members, and showing the tubing liner with the actuation member inserted in the liner and the collet sleeve and protuberances thereof having passed the first sliding sleeve member and continuing downhole in the liner;

FIG. 2B is a subsequent view of the tubing liner showing the actuation member having moved past the most uphole sliding sleeve member within the tubular liner, and moved downhole to the second sliding sleeve member of the second group of slidable sleeves, wherein protuberances on the collet sleeve thereof having engaged the corresponding circumferential groove on such second sliding sleeve member;

FIG. 2C is a subsequent view showing the actuation member having sheared the shear members initially retaining the second slidable sleeve member, and having moved such slidable sleeve member downhole so as to thereby uncover its associated port, and such actuation member having disengaged from such second sliding sleeve member and in the process of moving further downhole; and FIG. 2D is a subsequent view showing the actuation member having engaged the most downhole sliding sleeve member and having sheared the associated shear members thereof and having moved such sleeve member downhole so as to likewise uncover its associated port, with the plug member having further sheared its retaining shear pins and moved downhole within the collet sleeve thereby preventing the protuberances on the collet sleeve from disengaging from the associated sliding sleeve member and the plug member and associated collet sleeve being further prevented from moving further downhole;

FIGS. 4-8 show enlarged successive views of a most downhole sliding sleeve member and associated port when acted on by an actuation member, wherein:

FIG. 4 shows an actuation member having been placed in the tubing liner, and such actuation member approaching the most-downhole sliding sleeve member;

FIG. 5 shows the actuation member having engaged the circumferential groove(s) in the most-downhole sliding sleeve member;

FIG. 6 shows the plug member having sheared the shear pins retaining it in the uphole end of the collet sleeve, and the plug member having moved to the downhole end of the collet sleeve thereby preventing disengagement of the collet fingers with the circumferential groove;

FIG. 7 shows the collet sleeve and plug member having sheared the shear members retaining the slidable sleeve member in a closed position, and having moved the slidable sleeve member to the open position; and FIG. 8 shows the most downhole sleeve in the open position, with the plug member having dissolved.

DETAILED DESCRIPTION OF SOME PREFERRED EMBODIMENTS

Figures 1A, 1B, 1C, 1D:
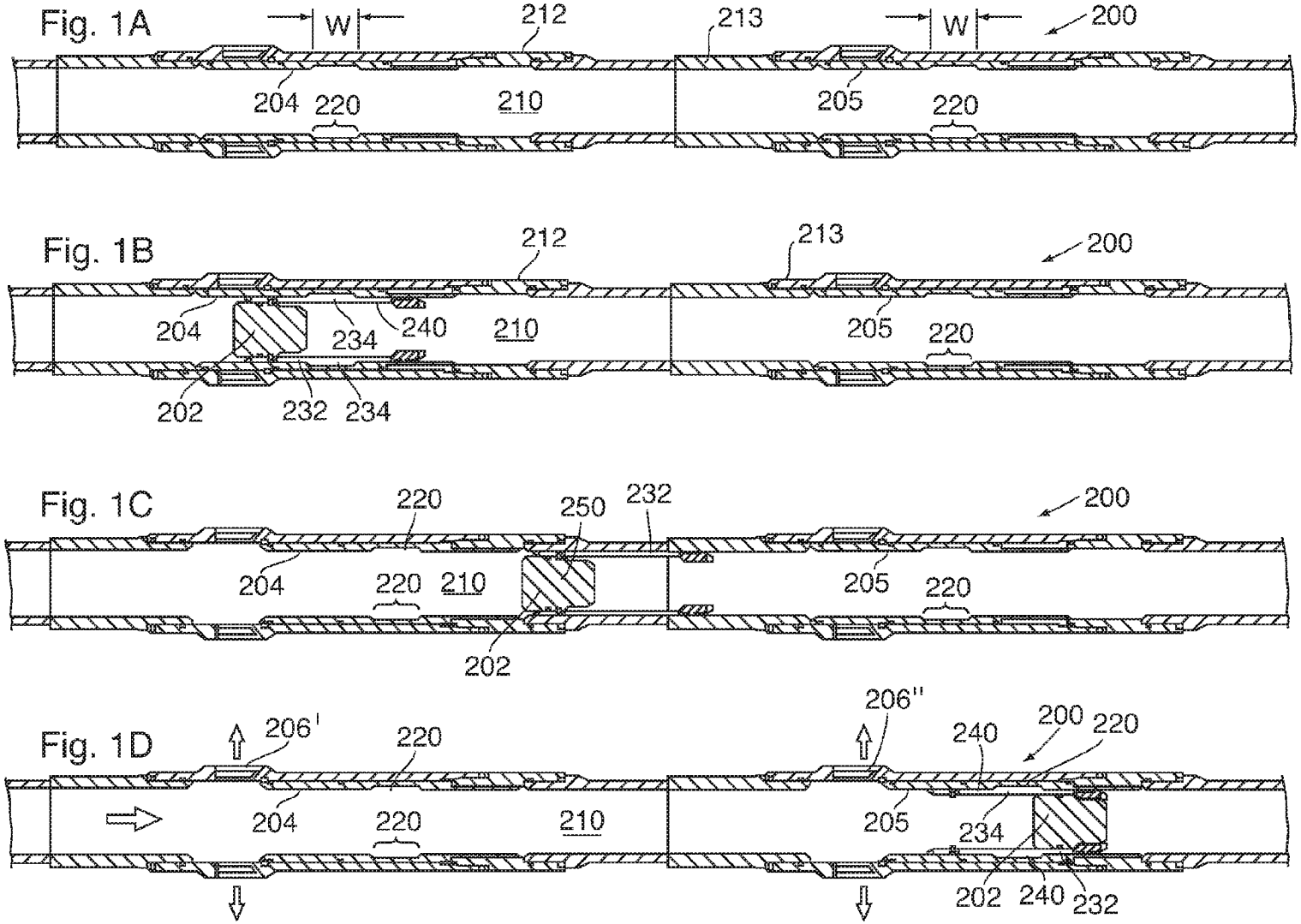

In the following description, similar components in the drawings are identified with corresponding same reference numerals.

The system of the present invention is to be used in the conditioning of a wellbore (i.e. "completion" of a wellbore in oilfield parlance) prior to production of hydrocarbons from such wellbore.

Specifically, the present system can advantageously be used to provide and allow the injection of pressurized fluid into a hydrocarbon-bearing formation at desired optimal locations along the wellbore, for the purposes of initially fracturing the hydrocarbon formation and/or injecting flow-enhancing agents into the formation (such as acids, flow enhancing agents, and/or proppants) all for the purpose and objective of increasing the rate and quantity of hydrocarbons to be subsequently recovered from the hydrocarbon formation.

A tubing liner 200 inserted into a drilled wellbore serves a variety of purposes, one of which is the reinforcement of the wellbore and preventing collapse of the wellbore, another of which is to allow supply of such completion fluids under pressure to desired zones of the hydrocarbon formation, via ports situated longitudinally in spaced-apart relation along the tubing liner.

FIG. 1A shows a portion of a tubing liner 200 for insertion into a drilled horizontal wellbore (not shown), incorporating portions of the system of the present invention.

Tubing liner 200 is typically constructed of segments of steel pipe members 211, 212. 213 each of uniform length threadably coupled together at their respective ends. Pipe members 211, 212, 213 are typically manufactured in various standardized lengths, widths, thicknesses, and material strengths, depending on the wellbore depth, diameter, pressures to which the tubing liner 200 will be exposed to, and the like. Tubing liners 200 typically contain a bore 210, and further possess a plurality ports, such as ports 206, 206', 206", which in certain conditions are permitted to fluidly communicate with bore 210. Ports 206, 206', 206" are initially closed during insertion of the tubing liner 200 into a wellbore, in order to avoid ingress into the bore 210 of detritus such as residual drill cuttings typically present in a wellbore which would otherwise clog ports 206, 206' and/or bore 210 thereby preventing collection of hydrocarbons in the tubing liner and/or preventing production of such hydrocarbons to surface.

FIGS. 1B-1D show the same tubing liner 200 in combination with an actuation member 202, which actuation member 202 is used to open selective ports 206, 206' in the manner hereinafter explained. FIGS. 1B-1D respectively depict the successive manner of operation of the actuation member 202 on the plurality of sliding sleeve members 204, 205 in the tubing liner 200 to successively open associated ports 206, 206' in tubing liner 200. Such components together broadly comprise the system of the present invention.

As may be seen from all figures herein, hollow cylindrical sliding sleeve members 203, 204, 205 are provided within tubing liner 200, initially each in a closed position overlapping and thereby covering respective ports 206, 206', 206" thus preventing fluid communication between bore 210 and any of ports 206, 206', 206". Each of sliding sleeve members 203, 204, 205 is provided with a circumferential groove or aperture 220, of a uniform width 'W' as shown in FIGS. 1A-1D. Alternatively, in a further refinement of the present invention as more fully explained herein, groups of sliding sleeve members possess circumferential grooves 220 of a given uniform width 'W1', whilst other groups of sliding sleeves possess circumferential grooves 220 of a greater uniform width 'W2', as shown in FIGS. 2A-2D herein.

Shear members, which in one embodiment comprise shear screws or shear pins 222, are provided to secure, at least initially, each of sliding sleeve members 203, 204, 205 to tubing liner 200, to thereby secure each of sleeve members 203, 204, 205 in an initial closed position overlapping each of respective ports 206, 206', 206". Shear screws 222 are configured to shear upon a force being applied to the respective sliding sleeve members 203, 204, 205 exceeding a given design value, so as to allow slidable downhole movement of sleeve members 203, 204, 205 to uncover a respective ports 206, 206', 206".

To operate the system of the present invention and open a single group of contiguous, spaced-apart ports 206', 206" as shown in FIGS. 1A-1D, an actuation member 202 is provided, positionable within bore 210. Actuation member 202 comprises a cylindrical hollow collet sleeve 232. Collet sleeve 232 possesses at least one radially-outwardly protruding and outwardly-biased protuberance 234. In a preferred embodiment the collet sleeve 232 possesses a plurality of elongate longitudinally extending and radially outwardly biased finger members 240 thereon, with each finger member 240 having thereon said radially-outwardly protruding protuberance 234.

Protuberance 234 is configured of a width equal to or slightly less than width 'W' of circumferential groove 220, to thereby allow matingly engagement with each of respective interior circumferential grooves 220 in each of sliding sleeve members 206', 206". Finger members 240, being radially outwardly biased, may be inwardly compressed to allow collet sleeve 232 and associated protuberances 234 to become radially inwardly compressed to thereby allow disengagement of collet sleeve 232 and protuberance 234 from a respective sliding sleeve member and associate groove 220, once the respective sliding sleeve member 204, 205 is moved so as to uncover respective port 206', 206", to thereby allow actuation member 202 to continue to move downhole and further actuate (open) all desired remaining sliding sleeve members 204, 205 having circumferential grooves 220 therein of width 'W".

A plug member 250 is provided within collet sleeve 232 of actuation member 202. Plug member 250 is initially secured by shear pins 275 to collet sleeve 232 at an uphole end of collet sleeve 232, as shown for example in FIGS. 1B, 1C, 2B, 2C, and FIG. 5. Of note, all instances of use of the term "shear pin" herein in this application means and includes any shear screw, shear pin, frangible weld or solder connection initially securing plug member 250 to uphole end of collet sleeve 232.

Shear pins 275, when a fluid pressure is applied on an unphole side of plug member 250 in excess of a given value, are adapted to shear so as to release plug member 250 from being secured to the uphole side of collet sleeve 232 and to then travel downhole within collet sleeve 232 to a downhole portion of collet sleeve 232, where further movement of plug member 250 is prevented by an extremity (a chamfered shoulder 255) of collet sleeve 232.

Figures 2A, 2B, 2C, 2D:
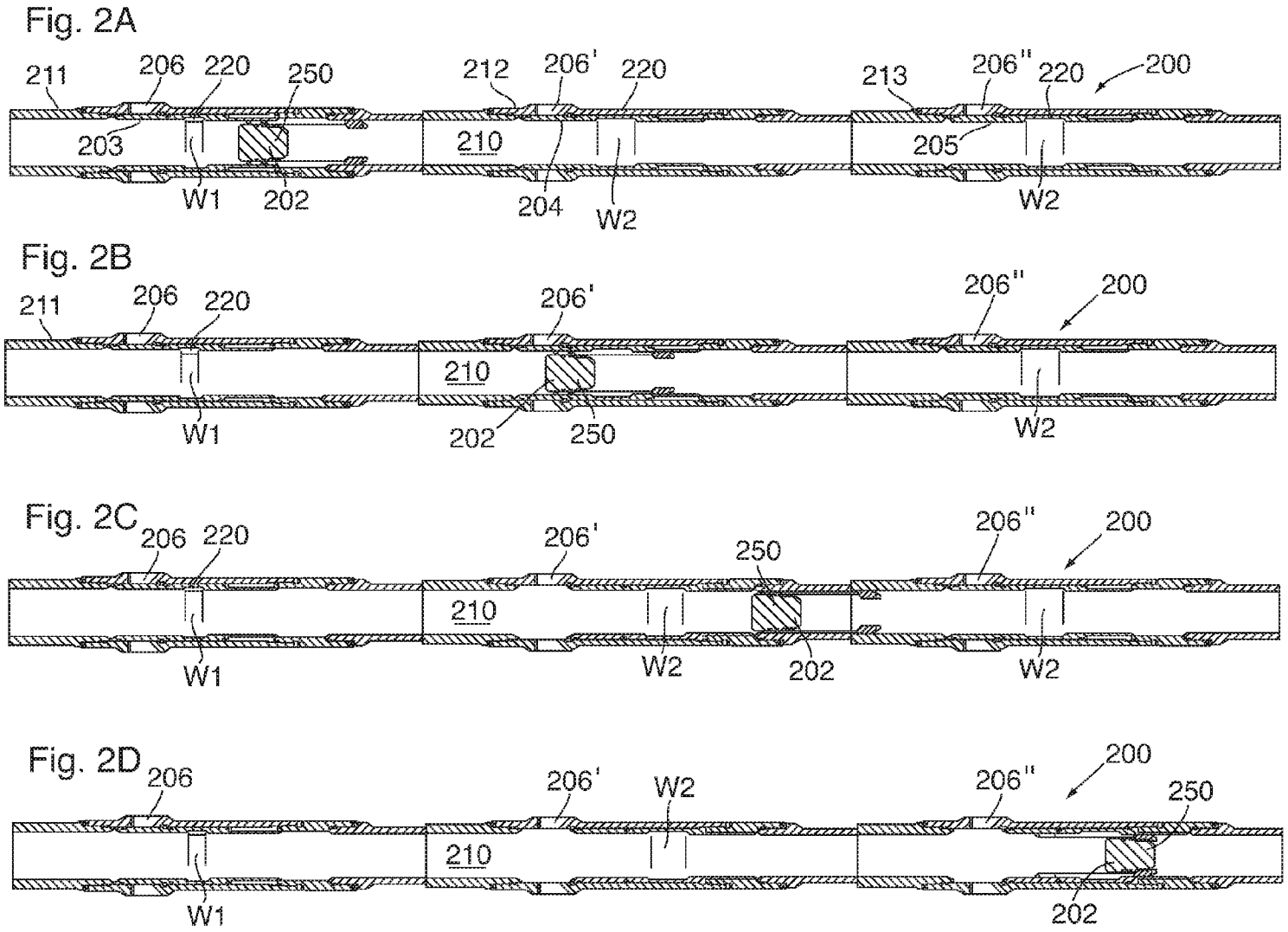

Fluid pressure applied to an uphole end of said actuation member 202 and plug member 250 causes collet sleeve 232 to move downhole, as shown in successive FIGS. 1B-1D, and in successive figures FIGS. 2B-2D, and engage circumferential grooves 220 in respective downhole sliding sleeve members 204, 205 and successively move sliding sleeve members 204, 205 downhole so as to thereby uncover each of corresponding ports 206', 206".

The fluid pressure required to shear said shear members 222 securing slidable sleeve members 204 is less than the fluid pressure required to shear said shear pins 275 securing said plug member 250 to said uphole end of said collet sleeve 232, save and except for the fluid pressure required to shear the shear members 220 securing the most downhole sliding sleeve member 205.

Figure 6:
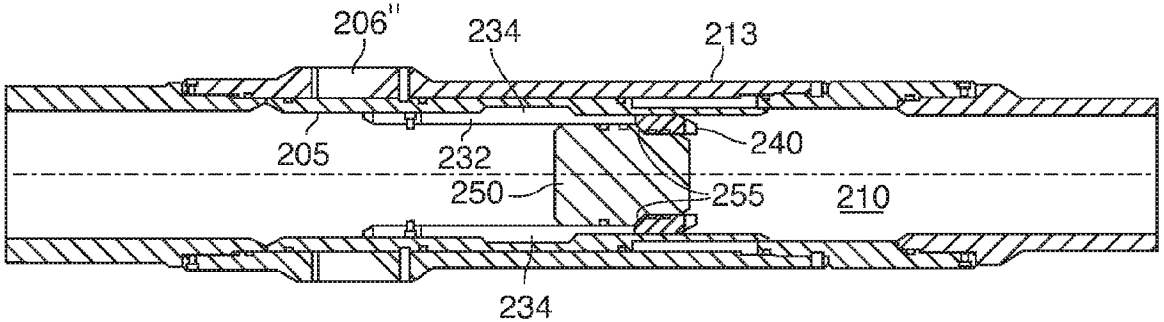

Accordingly, when opening a most-downhole sliding sleeve member 205, due to the higher shearing strength in shearing members 222 than shear pins 275, plug member 250 firstly shears shear pin 275 therein and thereby allows plug member 250 to move downhole in collet sleeve 232 from the first uphole position (FIG. 5) in collet sleeve 232 to the second position (ref. FIG. 6) where it is restrained by chamfered shoulders 255 on plug member 250. Movement of plug member 250 to the second position (ref. FIG. 1D and FIG. 6) thereby prevents protuberances 234 from being inwardly compressed Application of additional uphole fluid pressure acting on the plug member 250 then causes shearing members 222 securing most downhole sliding sleeve member 205 to shear, thus allowing the most downhole sliding sleeve to move downhole and thereby uncover the most downhole port 206" in the series of ports 206', 206".

In the system shown in FIGS. 1A-1D, and also for a system where individual discrete groups of ports are provided which are desired to be opened separately, for example uphole first ports 206 and a second downhole group of (second) ports 206', 206" and each of said first ports 206 and second ports 206', 206" are desired to be opened separately as shown in FIGS. 2A-2D, burst plates 300 may be provided which cover each of ports 206, 206', and 206. Burst plates 300, as shown in FIGS. 1A-1D, are adapted to rupture and allow fluid communication from bore 210 to a respective port 206', 206" when fluid pressure in bore 210 (*i*) exceeds the fluid pressure necessary to cause plug member 250 and collet sleeve 232 to shear the shear members 222, including the most downhole of the shear members 220 securing the most downhole sliding sleeve 205; and (ii) when the fluid pressure in bore 210 also exceeds the fluid pressure necessary to cause plug member 250 to shear the shear pins 275 and move plug member 250 to the second downhole position in collet sleeve 232. Burst ports 300 covering such first group of ports 206 may be provided with a different burst pressure than burst ports 300 covering ports 206', 206". In particular, when first ports 206 are located uphole of second ports 206', 206" as shown in FIGS. 2A-2D, burst plates covering second ports 206', 206" may have a lower burst pressure than burst ports covering uphole first ports 206.

FIGS. 2A-2D show the embodiment of the system discussed immediately above, namely were individual discrete groups of ports are provided, namely first ports 206 and second ports 206', 206" where each of said first ports and second ports 206', 206" are desired to be opened separately, but without burst plates 300 being provided.

Figure 3A:
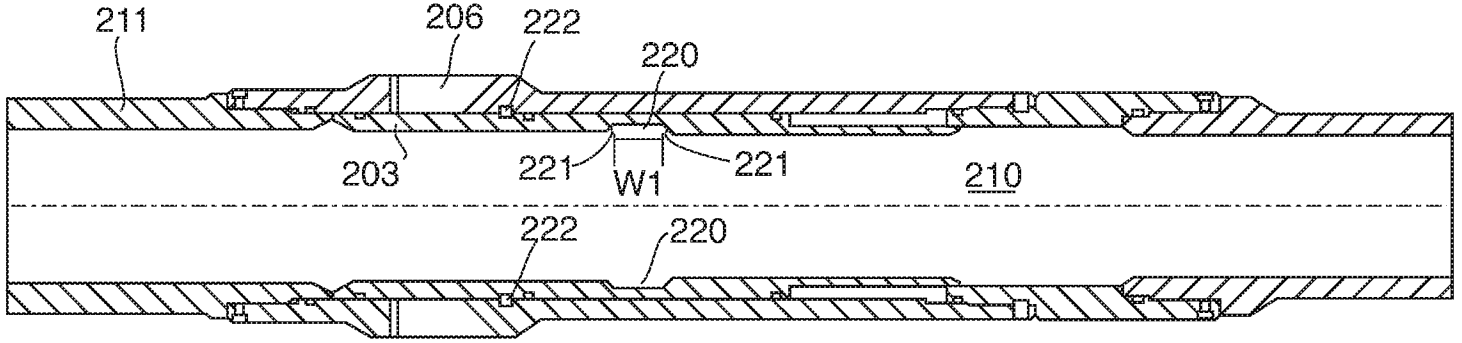
FIG. 3A-3B show two different types of sliding sleeve members-a first type as shown in FIG. 3A having a circumferential groove of width W1, and a second type as shown in FIG. 3B having a circumferential groove of width W2.
Figure 3B:
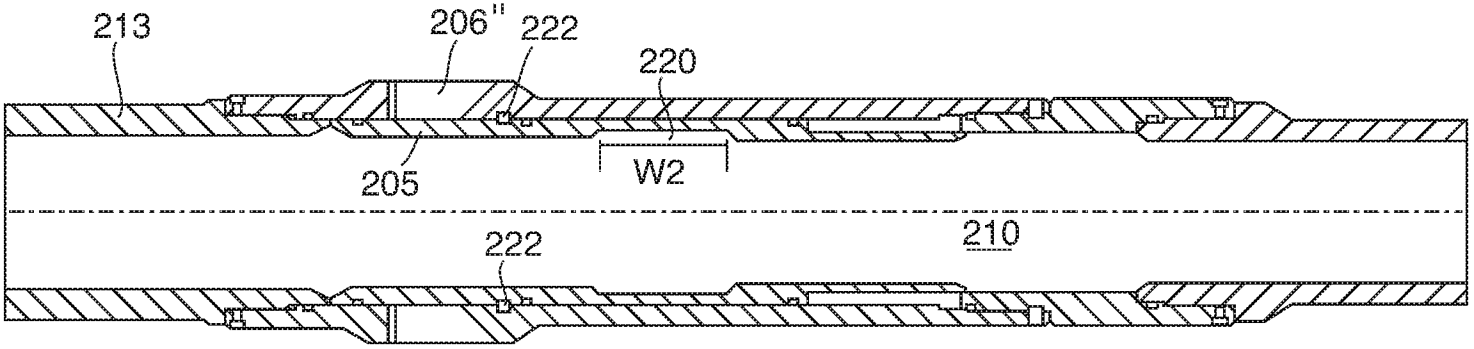
Figure 4:
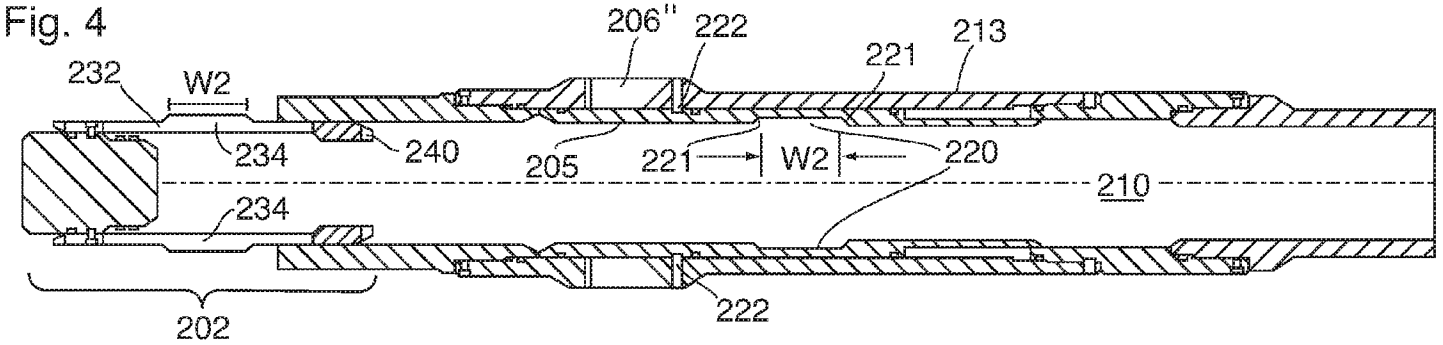
Figure 5:
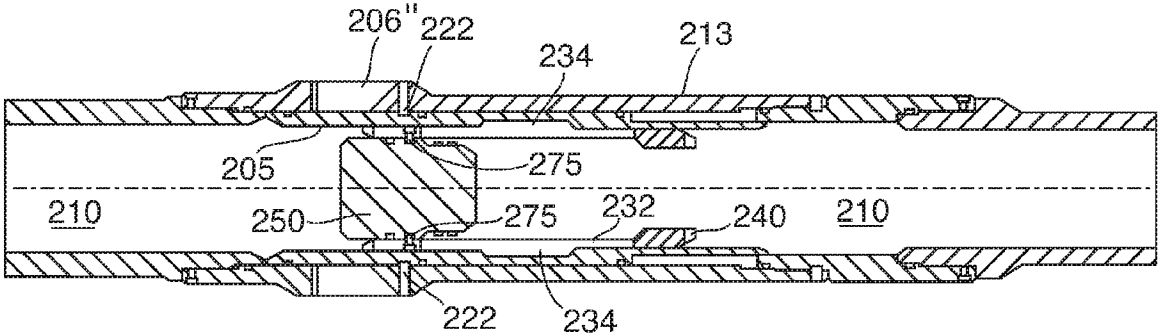

In such embodiment, a series/group of first uphole sleeve members 203, as shown in FIGS. 2A-2D and as best shown in enlarged view in FIG. 3A, are provided. Each of first ports 206 have an associated sliding sleeve member 203 which in a closed position overlaps port 206 preventing fluid communication with bore 201. Uphole sliding sleeve member 203 possesses a circumferential groove 220 of width W1, adapted to be matingly engaged by a protuberance 234 on an actuation member 202 to allow fluid pressure uphole of actuation member 202 to force actuation member 202 comprising collet sleeve 232 and plug member 250 downhole thereby likewise forcing sliding sleeve member 203 downhole thereby uncovering port 220. Chamfered edges 221 on groove 220 and continued fluid pressure exerted on actuation member 202 allow collet sleeve 232, and in particular collet fingers 240 thereon, to be radially inwardly compressed thereby causing protuberance 234 thereon to be likewise radially inwardly compressed, thereby freeing protuberances 234 from mating engagement with groove 220 and allowing continued downhole movement of actuation member 202 to actuate similar downhole slidable sleeve members having grooves 220 of similar or lesser widths W1.

In the embodiment of the system 200 shown in FIGS. 2A-2D, a second series/group of (second) ports 206', 206" are located downhole from said first ports 206, each of second ports 206', 206" having respective second sliding sleeve members 204, 205. Each of such sliding sleeve members 204, 205 have a circumferential groove 220 of width W2, wherein W2>W1.

Operation of Preferred Embodiment Shown in FIGS. 2A-2D and FIGS. 3A-FIG. 8

The manner of operation of the system 200 for uncovering two separate groups of ports, namely first ports 206, and second group of (second) ports 206', 206" as shown in FIGS. 2A-2D and FIGS. 3A-FIG. 8, is described below, and is in effect a duplication of the system shown in FIGS. 1A-1D described above, but with uphole sliding members 203 covering the group of first ports 206, such sliding members 203 (of the type shown in FIG. 3A) having grooves 220 thereon of a lesser width W1 than the circumferential grooves 220 of width W2 on associated sliding sleeve members 204, 205 of the type shown in FIG. 3B covering respective (second) ports 206', 206".

Specifically, as regards the operation of the system 200 for uncovering two separate groups of ports, a first actuation member 220 having thereon a protuberance 234 of width W2 is firstly inserted into bore 210, and propelled downhole by fluid pressure applied to bore 210. First actuation member 220, having a collet sleeve 232 and protuberances 234 thereon of width W2 does not engage circumferential groove 220 on (first) (uphole) sliding sleeve member(s) 203 covering first port 206 due to width W2 of protuberance 234 on first actuation member 220 being greater than width W1 of groove(s) 220 in first sliding sleeve member(s) 203. First actuation member 220 continues to travel further downhole in tubing liner 200.

First actuation member 202 when travelling further downhole then encounters sliding sleeve member 204 covering second port 206' (of the second group of second ports 206', 206"), and protuberance 234 matingly engages groove 220 therein, since width W2 of protuberance 234 on first actuation member is equal to (or somewhat less than) width W2 of groove 220 on collet sleeve 232. Fluid pressure on the uphole side of actuating member 202 causes further downhole movement thereof, causing sliding sleeve 204 to move downhole and thus uncover/open associated port 206'. A snap ring 270 may further engage the sliding sleeve 204 when in such open position, in order to retain sliding sleeve 204 in such position uncovering associated port 206'.

Due to chamfering (i.e. provision of chamfered shoulders 221) in groove 220, collet sleeve 232 (and in particular collet fingers 240 and protuberances 234 thereon) are radially inwardly compressed when downhole force is continued to be applied to actuation member 202, causing disengagement of protuberances 234 from groove 220. Such allows first actuation member 202 to continue to further downhole to actuate/open additional ports in said group of second ports 206', 206".

FIGS. 2C & 2D, along with FIGS. 4-7 showing an enlargement of the operation of the most-downhole sleeve 205 when actuated on by the first actuation member 202, and depict the system's operation in actuating the most-downhole sleeve 205 and uncovering the associated most-downhole (second) port 206".

Figure 7:
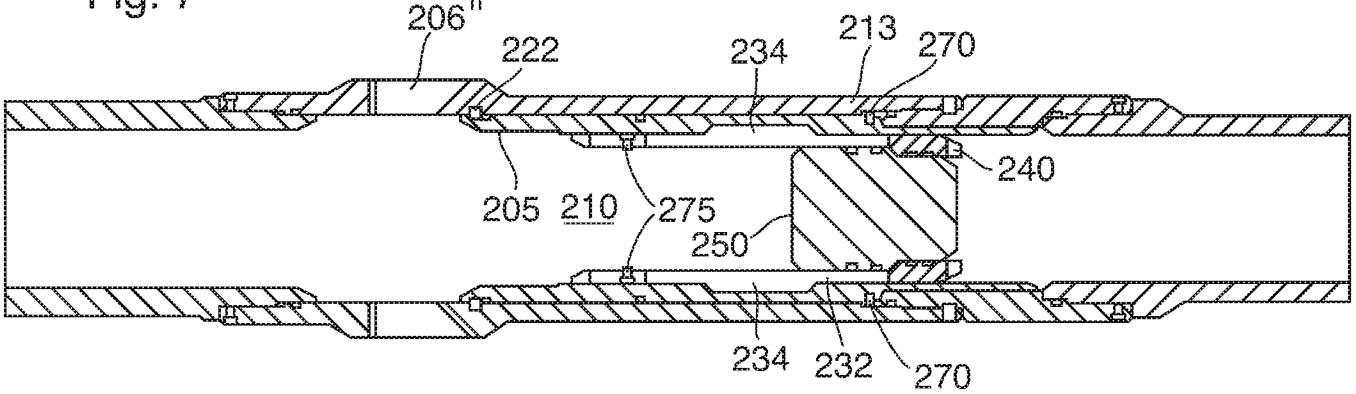
Figure 8:
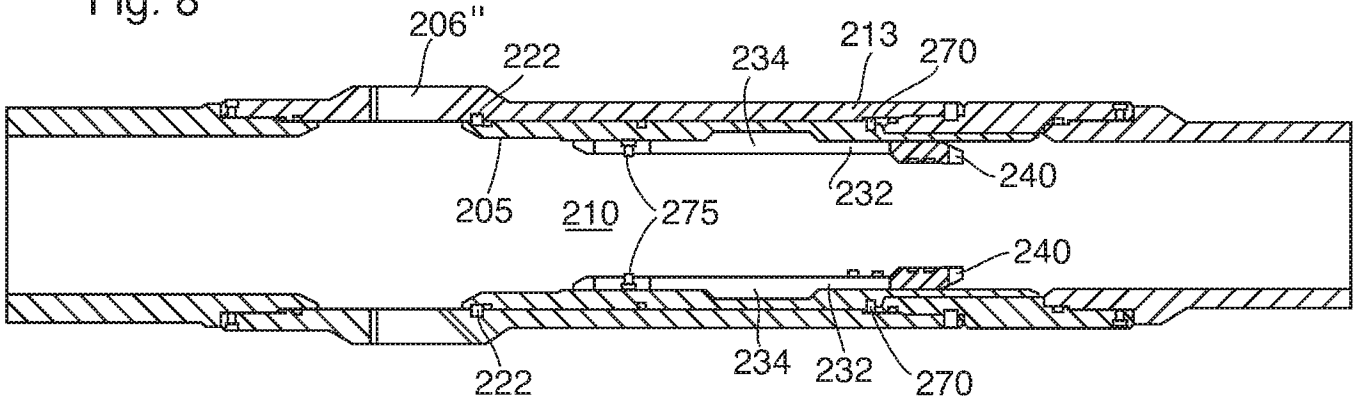

Upon protuberances 234 of width W2 on actuating member 202 encountering circumferential groove 220 on the most-downhole sliding sleeve 205 associated with downhole port 206", protuberance(s) 234 matingly engage groove 220 thereon. However, as the shear force necessary to shear the shear screws 222 securing sliding sleeve member 205 to associated pipe member 213 is greater than the force necessary to shear the shear pins 275 securing plug member 250 to uphole end of collet sleeve 232, continued fluid pressure acting on actuation member 202 therefore causes shear pins 275 to shear thereby allowing plug member 250 to slidably move to a second position within collet sleeve 232, namely to the downhole end of collet sleeve 232 as shown in FIG. 6, where shoulder members 255 on collet sleeve 232 arrest further movement downhole of plug member 250. Plug member 250 when is such second position prevents collet fingers 240 and associated protuberances 234 thereon from being inwardly radially compressed and thereby prevents protuberances 234 from becoming disengaged with circumferential groove 220 (ref. FIG. 6). Further fluid pressure applied to bore 210 uphole of first actuation member 202 then causes further downhole movement of plug member 202 thereby causing sliding sleeve 205 to move downhole and thus uncover/open associated port 206". A snap ring 270 may further be provided to engage sliding sleeve 205 when in such open position, to thereby retain sliding sleeve 204 in such position uncovering associated port 206", as shown in FIG. 7. Thereafter, fluid can be injected into the formation via open ports 206', 206", to allow fracking of the formation in the region of ports 206', 206".

Where a dissolvable plug member 250 has been used, action of fluid remaining in bore 210 dissolves plug member 250 leaving pipe members 212. 213 in a configuration to allow ingress of hydrocarbons from the formation via opened ports 206, 206', and 206" into the tubing liner for subsequent production to surface.

Alternatively, plug member 250 if not dissolvable may be reamed out by insertion of a reaming member (not shown) within liner 200 to thereby remove actuation member 202 and associated plug member 250 from within tubing liner 200 to prevent obstruction of fluids within liner 200.

In order to actuate/open additional uphole (first) port(s) 206 in a similar manner, in such further refinement another (second) actuating member 202 is employed, also having protuberance profiles 234 thereon. Second actuating member 202 differs only from the first actuating member 202 in that the second actuating member 202 has protuberances profiles 234 thereon of width W1, where W1 is less than the width W2 of protuberances 234 on first actuating member 202. The operation of second actuation member 202 on uphole sliding sleeve member(s) 203 to thereby actuate/uncover uphole (first) port(s) 206 is identical to the manner described above for utilizing first actuating member 202 in actuating downhole sliding sleeve members 204, 205 to open second ports 206', 206". Again, if desired, a snap ring 270 may further be provided to engage sliding sleeve 203 when in such open position, to thereby retain sliding sleeve 203 in such position uncovering associated port 206.

Again, if desired, burst ports may be provided over each of ports 206, 206', and 206". Likewise in such further embodiment utilizing groups of ports, burst plates 300 covering each of said ports in a plurality of groups of ports are expressly configured to rupture and allow fluid communication from said bore 210 only upon a fluid pressure in said bore exceeding:

(i) the fluid pressure necessary to cause plug member 250 in each of said first and second actuation member 202 and said associated collet sleeve 232 to shear the shear screws 222; and (ii) the fluid pressure necessary to cause plug member 250 in each of said first and second actuation members 202 to shear the shear pins affixing plug member 250 to the uphole side of collet sleeve 232 to shear and allow plug member 250 to move to said second position in each collet sleeve 232 when actuating/opening the most downhole sleeve in a group of ports.

The above description of some embodiments of the system and method of the present invention is provided to enable any person skilled in the art to make or use the present invention.

For a complete definition of the invention and its intended scope, reference is to be made to the summary of the invention and the appended claims read together with and considered with the disclosure and drawings herein.

Reference to an element in the singular, such as by use of the article "a" or "an" is not intended to mean "one and only one" unless specifically so stated, but rather "one or more". In addition, where reference to "fluid" is made, such term is considered meaning all liquids and gases having fluid properties.

Reference made to "lowermost", "lower, "uppermost", and "upper", and all other adjectives of relativistic reference mean in relation to the position of a component when placed in a vertical wellbore.

I claim:

1. A system for successively uncovering a plurality of contiguous spaced-apart ports along a wellbore, comprising:

(i) a tubular liner having a bore, further comprising:

(a) a plurality of said spaced-apart ports longitudinally and contiguously spaced along said tubular liner;

(b) a corresponding plurality of cylindrical sliding sleeve members, each longitudinally slidable within said bore, each configured in an initial closed position to overlap a corresponding of said ports, and when slidably moved to an open position to uncover said corresponding port, each of said sliding sleeve members having an interior circumferential groove therein;

(c) a shear member, initially securing said slidable sleeve members to said tubular member in said initial closed position, and sheareable when a force is applied to a respective of said slidable sleeve members;

(ii) an actuation member positioned within said bore, comprising:

(a) a cylindrical hollow collet sleeve, having a radially-outwardly biased and protruding protuberance, said protuberance configured to successively matingly engage each of said respective interior circumferential grooves on said sliding sleeve members, wherein said protuberance is of a substantially equal or lesser width than a width of said circumferential grooves on each of said sliding sleeve members, wherein said protuberance upon being inwardly compressed allows said collet sleeve and protuberance thereon to become disengaged from mating engagement in said circumferential groove;

(b) a plug member, situated within said collet sleeve and when in a first position situated at an uphole end thereof, which at least for a limited time together with said collet sleeve substantially obstructs passage of fluid within said bore when said collet sleeve and plug member are together situated in said bore;

(c) a shear pin, releasably securing said plug member to an uphole end of said collet sleeve, shearable when a force is applied to said plug member to cause said plug member to move downhole in said collet sleeve to a second position therein preventing said protuberance from thereafter being forcibly inwardly compressed and thereby maintaining said protuberance in mating engagement with said circumferential groove;

wherein fluid pressure applied to an uphole end of said actuation member causes said actuation member to move downhole and successively engage said circumferential groove in each of said sliding sleeve members and move said sliding sleeve members downhole so as to thereby uncover each of said plurality of ports;

wherein fluid pressure required to shear said shear members in all of said slidable sleeve members save and except for a most-downhole of said slidable sleeve members, is less than fluid pressure required to shear said shear pins securing said plug member to said uphole end of said collet sleeve; and wherein said plug member, when opening a most-downhole sliding sleeve member, shears said shear pin therein and moves downhole in said collet sleeve from said first position therein to said second position thereby preventing said protuberance from being inwardly compressed.

2. The system for successively uncovering said plurality of contiguous spaced-apart ports as claimed in claim 1, further having burst plates covering each of said ports, said burst plates adapted to rupture and allow fluid communication from said bore to said port only upon a fluid pressure in said bore exceeding:

(i) the fluid pressure necessary to cause said plug member and collet sleeve to shear said shear member; and (ii) the fluid pressure necessary to cause said plug member to shear said shear pin and move to said plug member to said second position.

3. The system for successively uncovering said plurality of contiguous spaced-apart ports as claimed in claim 1, wherein said plug member is dissolvable, and after moving to said second position and after a period of time being exposed to fluid within said bore, becomes dissolved.

4. The system for successively uncovering said plurality of contiguous spaced-apart ports as claimed in claim 1, further comprising:

(i) a snap-ring member, associated with each of said plurality of sliding sleeve members, which locks each sliding sleeve member in said open position upon said sliding sleeve member being moved to said open position.

5. The system for successively uncovering said plurality of contiguous spaced-apart ports as claimed in claim 1, wherein said plug member upon movement to said second position prevents said protuberance from being inwardly compressed, and said actuation member is further prevented along from further movement downhole.

6. A system for successively uncovering at a first and second group of contiguous spaced-apart ports along a wellbore, comprising:

(i) a tubular liner having a bore, further comprising:

(a) a plurality of first spaced-apart ports longitudinally and contiguously spaced along said tubular liner;

(b) a corresponding plurality of first cylindrical sliding sleeve members, each longitudinally slidable within said bore, each configured in an initial closed position to overlap a corresponding of said first ports and when slidably moved to an open position to not overlap said first port, each of said sliding sleeve members having an interior circumferential groove therein of a first width;

(c) a plurality of second spaced-apart ports longitudinally and contiguously spaced along said tubular liner, situated in said tubular liner downhole from said first ports;

(d) a corresponding plurality of second cylindrical sliding sleeve members, each longitudinally slidable within said bore, each configured in an initial closed position to overlap a corresponding of said second ports and when slidably moved to an open position to not overlap said corresponding second port, each of said second sliding sleeve members having an interior circumferential groove therein of a second width, wherein said second width is greater than said first width;

(e) shear members, respectively securing said first and second slidable sleeve members in said initial closed position, and sheareable when a force is applied to a respective of said first and second slidable sleeve members;

(ii) a first actuation member positioned within said bore, comprising:

(a) a cylindrical hollow collet sleeve, having a plurality of elongate longitudinally extending finger members thereon, said finger members having thereon a radially-outwardly biased and protruding protuberance, said protuberance configured to successively matingly engage said respective interior circumferential groove on each of said second sliding sleeve members, wherein said protuberance is of a width substantially equal to said second width but greater than said first width, wherein said protuberance upon fluid pressure being applied to an uphole side of said first actuation member is inwardly compressed to allow said collet sleeve and protuberance thereon to become disengaged from mating engagement in said circumferential groove in said second sliding sleeve members;

(b) a plug member, situated within said collet sleeve and when in a first position situated at an uphole end of said covet sleeve, which at least for a limited time together with said collet sleeve substantially obstructs passage of fluid within said bore when said collet sleeve and plug member are together situated in said bore;

(c) a shear pin, releasably securing said plug member to an uphole end of said collet sleeve, shearable when a force is applied to said plug member to allow said plug member to move downhole in said collet sleeve to a second position therein preventing said finger members from thereafter being forcibly inwardly compressed and thereby maintaining said protuberance in mating engagement with said circumferential groove;

wherein fluid pressure applied to an uphole end of said first actuation member causes said first actuation member to move downhole and cause said collet sleeve thereof to successively engage said second circumferential groove in each of said second slidable sleeve members and move each of said second sliding sleeve members downhole so as to thereby uncover each of said plurality of second ports;

wherein fluid pressure required to shear said shear members in all of said second slidable sleeve members save and except for a most-downhole of said slidable sleeve members, is less than fluid pressure required to shear said shear pins securing said plug member to said uphole end of said collet sleeve; and wherein said plug member in said first actuation member, when opening a most-downhole second sliding sleeve member, shears said shear pin therein and moves downhole in said collet sleeve from said first position therein to said second position thereby preventing said protuberance from being inwardly compressed;

said system further comprising:

(iii) a second actuation member positioned within said bore, comprising:

(a) a cylindrical hollow collet sleeve, having a plurality of elongate longitudinally extending finger members thereon, said finger members having thereon a radially-outwardly protruding protuberance, said protuberance configured to successively matingly engage said respective interior circumferential groove on each of said first sliding sleeve members, wherein said protuberance is of a width substantially equal to said first width, but less than said second width, wherein said protuberance upon fluid pressure being applied to an uphole side of said second actuation member is inwardly compressed to allow said collet sleeve and protuberance thereon to become disengaged from mating engagement in said first circumferential groove in each of said first sliding sleeve members;

(b) a plug member, situated within said collet sleeve and when in a first position situated at an uphole end thereof, which at least for a limited time together with said collet sleeve substantially obstructs passage of fluid within said bore when said collet sleeve and plug member are together situated in said bore;

(c) a shear pin, releasably securing said plug member to an uphole end of said collet sleeve, shearable when a force is applied to said plug member to cause said plug member to move downhole in said collet sleeve to a second position therein preventing said finger members from thereafter being forcibly inwardly compressed and thereby maintaining said protuberance in mating engagement with said circumferential groove;

wherein fluid pressure applied to an uphole end of said second actuation member causes said second actuation member to move downhole and said collet sleeve thereof to successively engage said circumferential grooves in each of said first slidable sleeve members and move each of said first sliding sleeve members downhole so as to thereby uncover each of said plurality of first ports; and wherein fluid pressure required to shear said shear members in all of said first slidable sleeve members save and except for a most-downhole of said first slidable sleeve members, is less than fluid pressure required to shear said shear pins securing said plug member to said uphole end of said collet sleeve of said second actuation member.

7. The system for successively uncovering said plurality of contiguous spaced-apart ports as claimed in claim 6, further having burst plates covering each of said ports, said burst plates adapted to rupture and allow fluid communication from said bore to said port only upon a fluid pressure in said bore exceeding:

(i) the fluid pressure necessary to cause said plug member in each of said first and second actuation member and said associated collet sleeve to shear said shear member; and (ii) the fluid pressure necessary to cause said plug member in each of said first and second actuation member to shear said shear pin and move to said plug member to said second position in each collet sleeve.

8. The system as claimed in claim 7, wherein said plug member in said second actuation member, when opening a most-downhole sliding sleeve member, shears said shear pin therein and moves downhole in said collet sleeve from said first position therein to said second position thereby preventing said protuberance from being inwardly compressed.

9. The system as claimed in claim 8, wherein said plug member in said second actuation member is dissolvable in a fluid which may be injected downhole.

10. The system as claimed in claim 7, wherein said plug member in said second actuation member is dissolvable in a fluid which may be injected downhole.

11. The system as claimed in claim 6, wherein said plug member in said second actuation member, when opening a most-downhole sliding sleeve member, shears said shear pin therein and moves downhole in said collet sleeve from said first position therein to said second position thereby preventing said protuberance from being inwardly compressed.

12. The system as claimed in claim 11, wherein said plug member in said second actuation member is dissolvable in a fluid which may be injected downhole.

13. The system as claimed in claim 6, wherein said plug member in said second actuation member is dissolvable in a fluid which may be injected downhole.

* * * * *